US010014572B2

(12) United States Patent
Tagi et al.

(10) Patent No.: US 10,014,572 B2
(45) Date of Patent: Jul. 3, 2018

(54) ANTENNA DEVICE, WIRELESS COMMUNICATION APPARATUS, AND RADAR APPARATUS

(71) Applicant: Panasonic Intellectual Property Management Co., Ltd., Osaka (JP)

(72) Inventors: Hiroyoshi Tagi, Kanagawa (JP); Hideki Iwaki, Kanagawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 118 days.

(21) Appl. No.: 15/140,275

(22) Filed: Apr. 27, 2016

(65) Prior Publication Data

US 2016/0344093 A1 Nov. 24, 2016

(30) Foreign Application Priority Data

May 20, 2015 (JP) ..... 2015-102842

(51) Int. Cl.
*H01Q 1/52* (2006.01)
*H01Q 15/00* (2006.01)
(Continued)

(52) U.S. Cl.
CPC ..... *H01Q 1/38* (2013.01); *H01Q 1/243* (2013.01); *H01Q 1/48* (2013.01); *H01Q 1/521* (2013.01);
(Continued)

(58) Field of Classification Search
CPC .. H01Q 15/006; H01Q 15/08; H01Q 15/0086; H01Q 1/52; H01Q 1/521; H01Q 1/525
See application file for complete search history.

(56) References Cited

U.S. PATENT DOCUMENTS 6,628,242 B1 * 9/2003 Hacker ..... H01P 1/2005 333/248
7,215,301 B2 * 5/2007 Choi ..... H01Q 15/006 343/700 MS
(Continued)

FOREIGN PATENT DOCUMENTS

| | | |
|---|---|---|
| JP | 2007-243375 | 9/2007 |
| JP | 2010-028182 | 2/2010 |
| JP | 2011-055306 | 3/2011 |

OTHER PUBLICATIONS

Choi et al., "Isolation Enhancement between Microstrip Patch Antennas using Dual-band EBG Structure without common Ground Plane," Antennas and Propagation Society International Symposium (APSURSI), 2012, IEEE, Jul. 8-14, 2012, 2 pages.
(Continued)

*Primary Examiner* — Tho G Phan
*Assistant Examiner* — Patrick Holecek
(74) *Attorney, Agent, or Firm* — Seed IP Law Group LLP

(57) ABSTRACT

An antenna device of the present disclosure includes: a dielectric layer; first and second conductor layers provided on both surfaces, respectively, of the dielectric layer; first and second antenna elements provided in the first conductor layer; a grounded conductor provided in the second conductor layer; and an EBG structure provided between the first and second antenna elements, wherein the EBG structure includes a first EBG portion provided in the first conductor layer, the first EBG portion including a plurality of first patch conductors electromagnetically coupled to the grounded conductor, and a second EBG portion provided in the second conductor layer, the second EBG portion including a plurality of second patch conductors electromagnetically coupled to the grounded conductor.

6 Claims, 11 Drawing Sheets

(51) Int. Cl.

| | |
|---|---|
| ***H01Q 1/38*** | (2006.01) |
| ***H01Q 1/48*** | (2006.01) |
| ***H01Q 1/24*** | (2006.01) |
| *H01Q 21/06* | (2006.01) |

(52) U.S. Cl.
CPC ..... *H01Q 1/525* (2013.01); *H01Q 15/008* (2013.01); *H01Q 21/06* (2013.01)

(56) References Cited

U.S. PATENT DOCUMENTS

| | | | | |
|---|---|---|---|---|
| 7,903,040 | B2 * | 3/2011 | Gevorgian | H01P 1/2005 343/767 |
| 8,081,117 | B2 * | 12/2011 | Nagai | H01Q 1/38 343/700 MS |
| 8,158,889 | B2 * | 4/2012 | Kim | H01P 1/2005 174/261 |
| 9,269,999 | B2 * | 2/2016 | Toyao | H01P 1/2005 |
| 9,357,633 | B2 * | 5/2016 | Kobayashi | H01Q 15/008 |
| 2007/0182639 | A1 * | 8/2007 | Sievenpiper | H01Q 15/008 343/700 MS |
| 2010/0127943 | A1 | 5/2010 | Inoue et al. | |
| 2010/0265159 | A1 | 10/2010 | Ando et al. | |
| 2011/0212697 | A1 | 9/2011 | Aoki et al. | |

OTHER PUBLICATIONS

Kim et al., "A Wideband and Compact EBG Structure With a Circular Defected Ground Structure," *IEEE Transactions on Components, Packaging and Manufacturing Technology 4*(3):496-503, 2014.

Extended European Search Report, dated Oct. 17, 2016, for corresponding EP Application No. 16166767.0-1811, 12 pages.

* cited by examiner

ANTENNA DEVICE, WIRELESS COMMUNICATION APPARATUS, AND RADAR APPARATUS

BACKGROUND

1. Technical Field

The present disclosure relates to an antenna device including a plurality of antenna elements and an EBG (electromagnetic band gap) structure. The present disclosure also relates to a wireless communication apparatus including such an antenna device and a radar apparatus including such an antenna device.

2. Description of the Related Art

Conventionally, it has been known that in an antenna device including a plurality of antenna elements and communicating in a millimeter-wave band, an EBG structure is used to ensure isolation between the antenna elements (see Japanese Patents Nos. 4650302, 5112204, and 5212949) Since the EBG structure becomes higher in impedance at a predetermined frequency (antiresonant frequency), the antenna device including the EBG structure can enhance the isolation between the antenna elements at the frequency.

A known example of the EBG structure is one that includes mushroom conductors including a plurality of patch conductors formed on a dielectric substrate, a plurality of via conductors, and a grounded conductor. The performance of the mushroom EBG structure depends on the diameter of each of the via conductors, the minimum size of each of the patch conductors, and the like. When the size of the conventional EBG structure is optimized so that the isolation between the antenna elements in the EBG structure is enhanced, high isolation is achieved only in a limited frequency bandwidth. Therefore, the conventional EBG structure has difficulty in ensuring sufficiently high isolation across a wide frequency bandwidth.

Meanwhile, providing an additional component or the like to change the antiresonant frequency of the EBG structure causes an increase in size of the antenna device and also causes an increase in cost.

SUMMARY

One non-limiting and exemplary embodiment provides an antenna device including an EBG structure and being capable of ensuring high isolation across a wide frequency bandwidth.

One non-limiting and exemplary embodiment further provides a wireless communication apparatus including such an antenna device and a radar device including such an antenna device.

In one general aspect, the techniques disclosed here feature: an antenna device including: a dielectric layer having a first surface on which a first conductor layer is provided and a second surface on which a second conductor layer is provided; a first antenna element provided in the first conductor layer; a second antenna element provided in the first conductor layer; a first grounded conductor provided in the second conductor layer; and an EBG (electromagnetic band gap) structure provided between the first antenna element and the second antenna element, wherein the EBG structure includes a first EBG portion provided in the first conductor layer, the first EBG portion including a plurality of first patch conductors electromagnetically coupled to the first grounded conductor, and a second EBG portion provided in the second conductor layer, the second EBG portion including a plurality of second patch conductors electromagnetically coupled to the first grounded conductor.

An antenna device including an EBG structure according to one general aspect of the present disclosure can ensure high isolation across a wide frequency bandwidth.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

In the following, an antenna device according to an embodiment is described with reference to the drawings. The same components, when denoted by reference signs, shall, throughout the following description, be denoted by the same signs.

First Embodiment

Figure 1:
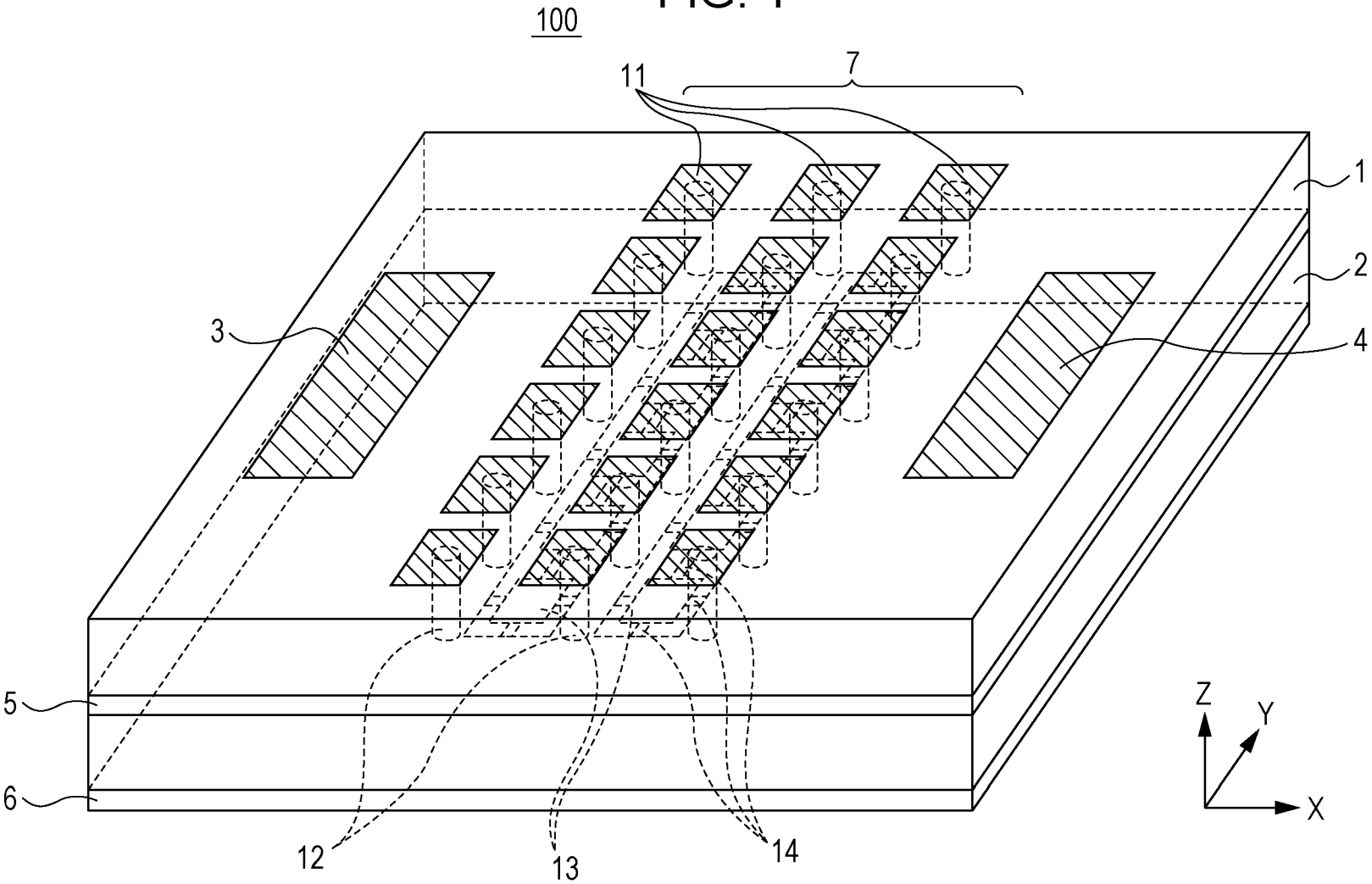
FIG. 1 shows a configuration of an antenna device 100.
Figure 2:
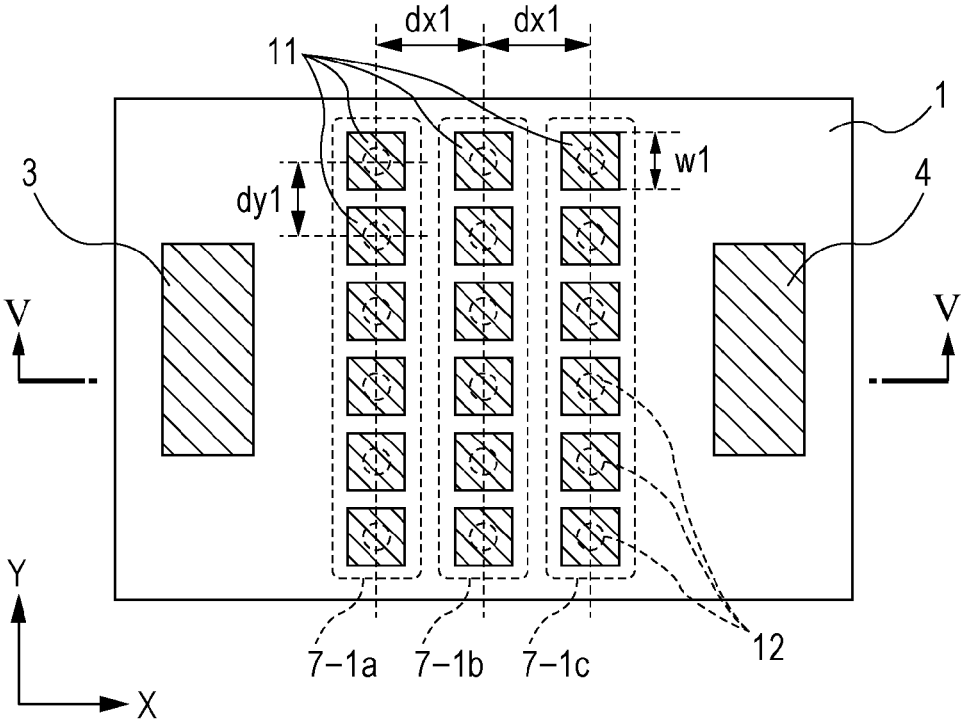
FIG. 2 is a top view of a first conductor layer of the antenna device 100.
Figure 3:
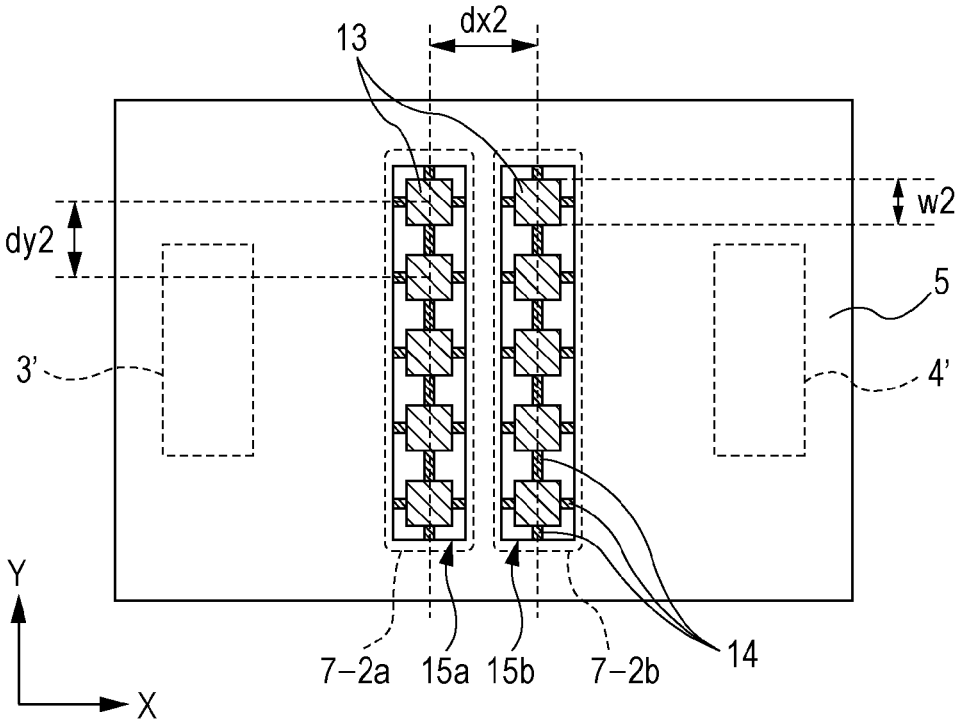
FIG. 3 is a top view of a second conductor layer of the antenna device 100.
Figure 4:
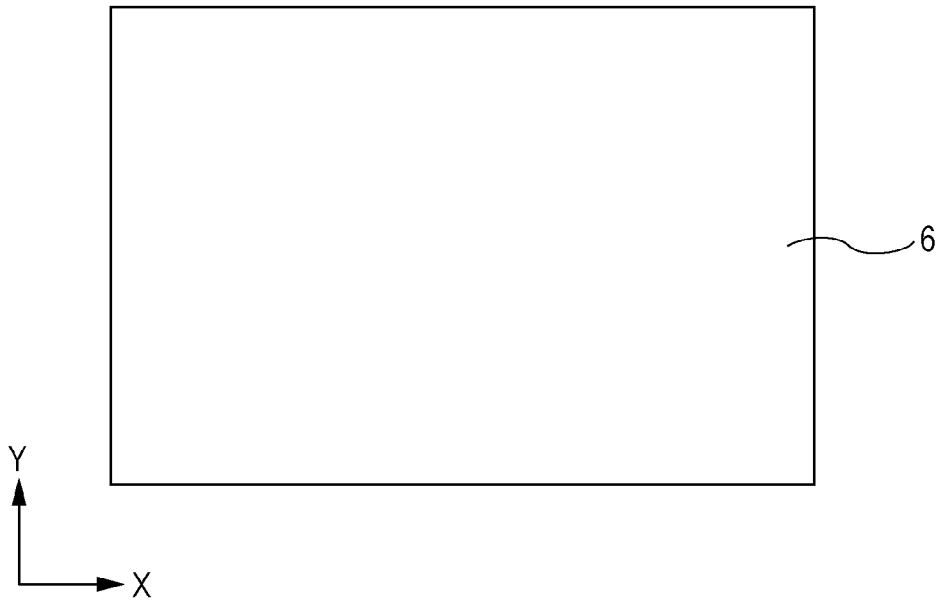
FIG. 4 is a top view of a third conductor layer of the antenna device 100.
Figure 5:
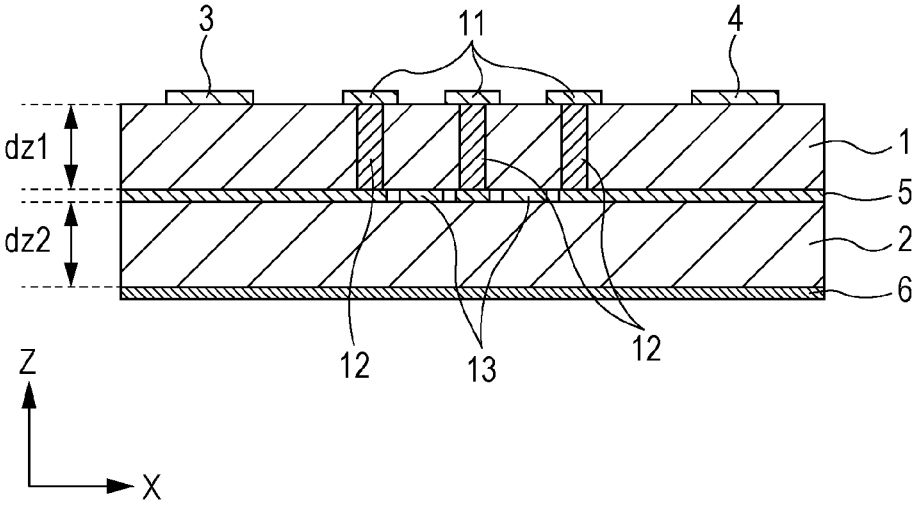
FIG. 5 is a cross-sectional view of the antenna device 100 as taken along the line V-V in FIG. 2.

FIG. 1 is a perspective view showing an antenna device 100 according to a first embodiment. FIG. 2 is a top view showing a first conductor layer of the antenna device 100 shown in FIG. 1. FIG. 3 is a top view showing a second conductor layer of the antenna device 100 shown in FIG. 1, FIG. 4 is a top view showing a third conductor layer of the antenna device 100 shown in FIG. 1. FIG. 5 is a cross-sectional view of the antenna device 100 as taken along the line V-V in FIG. 2.

The antenna device 100 includes a substrate. The substrate includes dielectric layers 1 and 2, a first conductor layer provided on an upper surface of the dielectric layer 1, a second conductor layer provided between the dielectric layers 1 and 2, and a third conductor layer provided on a lower surface of the dielectric layer 2. In other words, the first and second conductor layers are provided on both surfaces, respectively, of the first dielectric layer 1, and the third conductor layer is provided on one surface of the dielectric layer 2 in parallel with the second conductor layer at a predetermined distance from the second conductor layer on a side opposite to the first conductor layer. The antenna device 100 further includes a first antenna element 3 (receiving antenna) provided in the first conductor layer, a second antenna element 4 (transmitting antenna) provided in the first conductor layer, an EBG structure 7, a first grounded conductor 5 provided in the second conductor layer, and a second grounded conductor 6 provided in the third conductor layer. The EBG structure 7 is provided between the antenna elements 3 and 4. For example, the antenna element 3 may operate as a receiving antenna, and the antenna element 4 may operate as a transmitting antenna.

The dielectric layers 1 and 2 may be composed, for example, of polyphenylene ether or polytetrafluoroethylene.

The EBG structure 7 includes a first EBG portion and a second EBG portion. The first EBG portion includes a plurality of first patch conductors 11 provided in the first conductor layer and electromagnetically coupled to the grounded conductor 5. The second EBG portion includes a plurality of second patch conductors 13 provided in the second conductor layer and electromagnetically coupled to the grounded conductor 5. The plurality of patch conductors 13 are electromagnetically coupled to the grounded conductor 6.

In the example shown in FIG. 1, each of the patch conductors 11 and 13 has a square shape. However, each of the patch conductors 11 and 13 may have any shape such as a triangular shape, a hexagonal shape, or a rectangular shape.

As shown in FIG. 2, the plurality of patch conductors 11 are arranged in the first conductor layer along a plurality of first columns (columns extending in a Y direction in FIG. 2) crossing (orthogonal to) a line segment connecting the antenna elements 3 and 4. The first EBG portion includes a plurality of via conductors 12 penetrating the dielectric layer 1 and connecting the plurality of patch conductors 11 to the grounded conductor 5. Thus, the first EBG portion is in the form of a mushroom EBG structure. In the present disclosure, those patch conductors 11 and via conductors 12 which are arranged in the plurality of first columns are referred to as "EBG segments 7-1*a*, 7-1*b*, and 7-1*c*", respectively.

As shown in FIG. 3, the plurality of patch conductors 13 are arranged along a plurality of second columns crossing (orthogonal to) a line segment connecting a region 3' in the second conductor layer that faces the antenna element 3 and a region 4' in the second conductor layer that faces the antenna element 4. The second EBG portion includes a plurality of stub conductors 14 connected to the plurality of patch conductors 13. The plurality of stub conductors 14 are arranged, for example, along an X direction or Y direction in FIG. 3. The plurality of stub conductors 14 may be short-circuited with the grounded conductor 5 or may have open ends without being short-circuited with the grounded conductor 5. The second conductor layer is provided with slots 15*a* and 15*b* in which the patch conductors 13 and the stub conductors 14 are provided. Thus, the second EBG portion is in the form of a via-less EBG structure. In the present disclosure, those patch conductors 13 and stub conductors 14 which are arranged in the plurality of second columns are referred to as "EBG segments 7-2*a* and 7-2*b*", respectively.

When viewed from above, the EBG segments 7-1*a*, 7-1*b*, and 7-1*c* (in particular the positions where the via conductors 12 are connected to the grounded conductor 5) and the EBG segments 7-2*a* and 7-2*b* appear to be alternately arranged.

The EBG segments 7-1*a*, 7-1*b*, and 7-1*c* are for example provided parallel to each other and separated from each other by a distance equivalent to a wavelength corresponding to a center frequency of an isolation band that is a frequency band that enhances isolation between the antenna elements 3 and 4. The EBG segments 7-2*a* and 7-2*b* are also for example provided parallel to each other and separated by a distance equivalent to the wavelength corresponding to the center frequency of the isolation band. The distance between the EBG segments 7-1*a*, 7-1*b*, and 7-1*c* may be a distance that is 0.8 to 1.2 times longer than the wavelength corresponding to the center frequency of the isolation band. Similarly, the distance between the EBG segments 7-2*a* and 7-2*b* may be a distance that is 0.8 to 1.2 times longer than the wavelength corresponding to the center frequency of the isolation band.

In FIG. 2, "w1" is the length of one side of each of the patch conductors 11, "dx1" is the distance between the centers of two patch conductors 11 that are adjacent to each other in the X direction (or the distance between the EBG segments 7-1*a* and 7-1*b* or the distance between the EBG segments 7-1*b* and 7-1*c*), and "dy1" is the distance between the centers of two patch conductors 11 that are adjacent to each other in the Y direction. In FIG. 3, "w2" is the length of one side of each of the patch conductors 13, "dx2" is the distance between the centers of two patch conductors 13 that are adjacent to each other in the X direction (or the distance between the EBG segments 7-2*a* and 7-2*b*), and "dy2" is the distance between the centers of two patch conductors 13 that are adjacent to each other in the Y direction. In FIG. 5, "dz1" is the distance between each of the patch conductors 11 and the grounded conductor 5 (or the length of each of the via conductors 12), and "dz2" is the distance between the grounded conductors 5 and 6. Further, each of the via conductors 12 has a diameter φ.

The first EBG portion is exposed on a surface of the substrate (dielectric layer 1), and the second EBG portion is provided in an inner part of the substrate (i.e., between the dielectric layer 1 and the dielectric layer 2). Therefore, the first EBG portion and the second EBG portion are different in characteristics from each other. The numbers of patch conductors 11 and 13, the length w1 of one side of each of the patch conductors 11, the length w2 of one side of each of the patch conductors 13, and the distances dy1 and dy2 may be set and differ from each other according to the characteristics required for the first EBG portion and the second EBG portion.

The antenna device 100 shown in FIG. 1 operates (communicates), for example, in a millimeter-wave band. However, without being limited to a millimeter-wave band, the antenna device 100 shown in FIG. 1 may operate at any frequencies, provided it can ensure isolation.

The plurality of stub conductors 14 may be short-circuited with the grounded conductor 5 according to a desired isolation characteristic.

A change in the electromagnetic coupling between the second EBG portion and the grounded conductor 5 allows the second EBG portion to have its isolation band extended to a lower band side or a higher band side.

The antenna device 100 shown in FIG. 1 can ensure high isolation across a wide frequency bandwidth without an increase in size of the antenna device.

Figure 6:
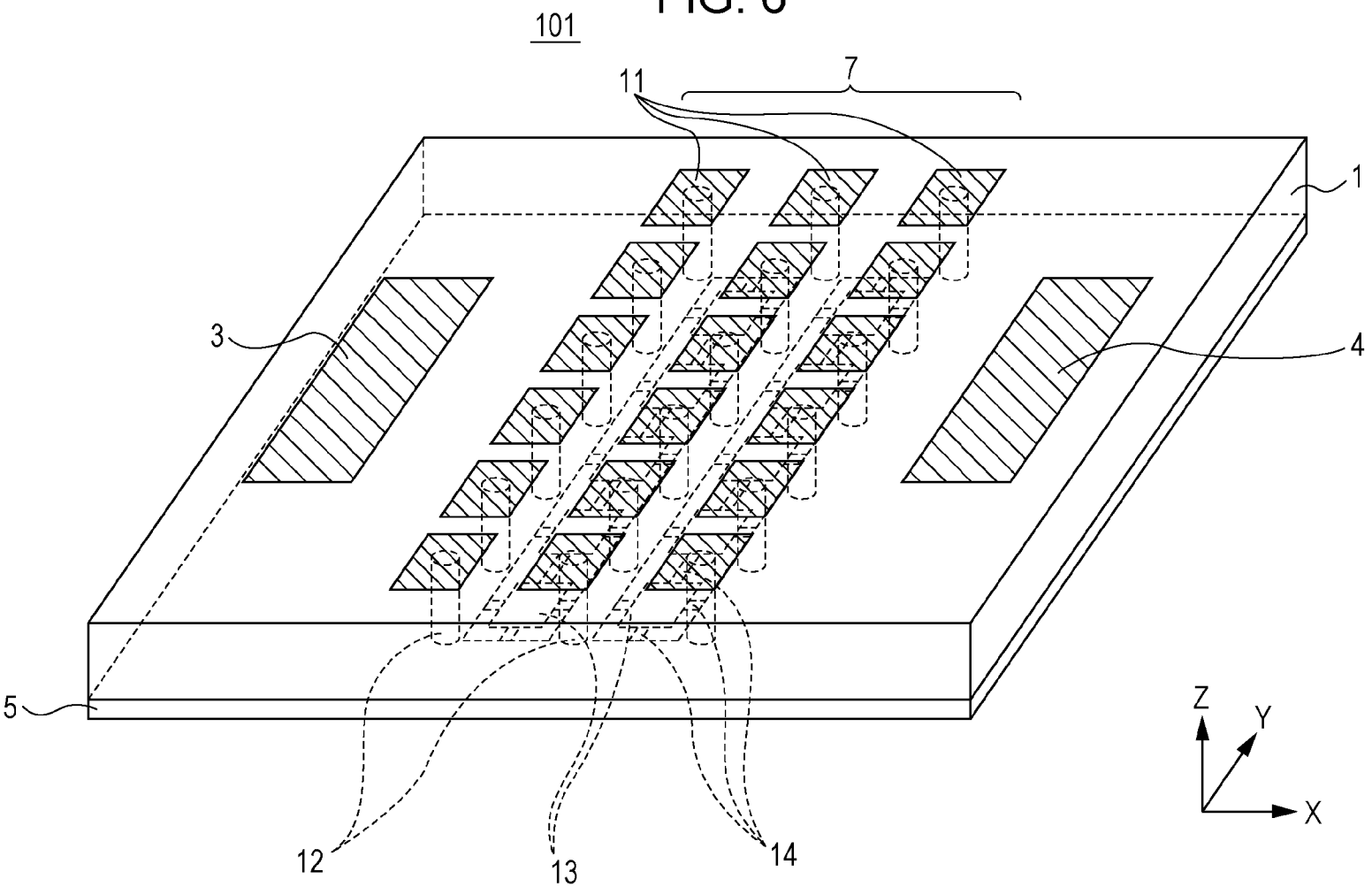
FIG. 6 shows a configuration of an antenna device 101.

FIG. 6 is a perspective view showing an antenna device 101 according to a modification of the first embodiment. Depending on the desired isolation characteristic, the grounded conductor 6 and the dielectric layer 2 of the antenna device 100 shown in FIG. 1 may be omitted.

Next, operation of the antenna device 100 shown in FIG. 1 is described with reference to FIGS. 7 to 14.

Figure 7:
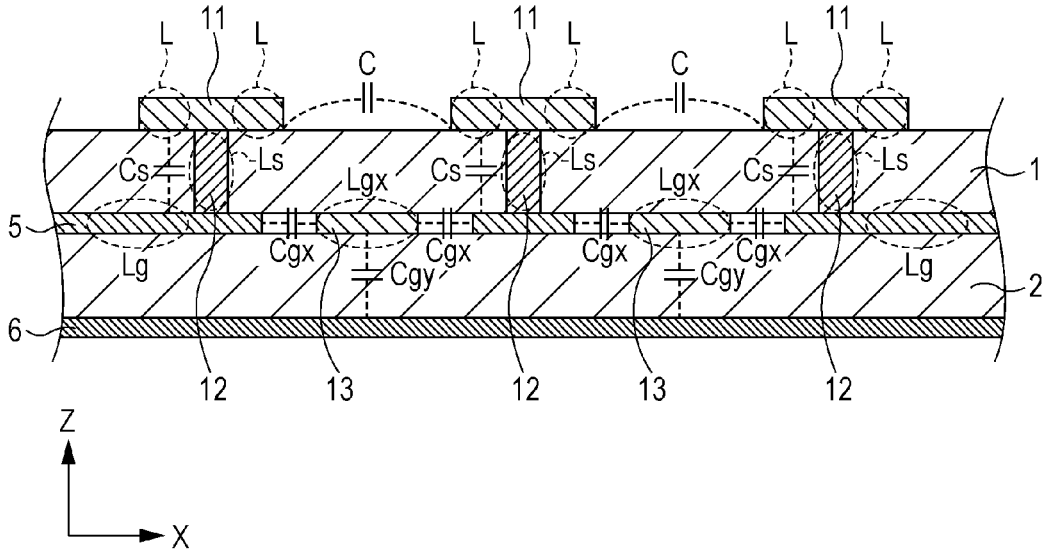
FIG. 7 shows a configuration of an EBG structure 7 of the antenna device 100.
Figure 8:
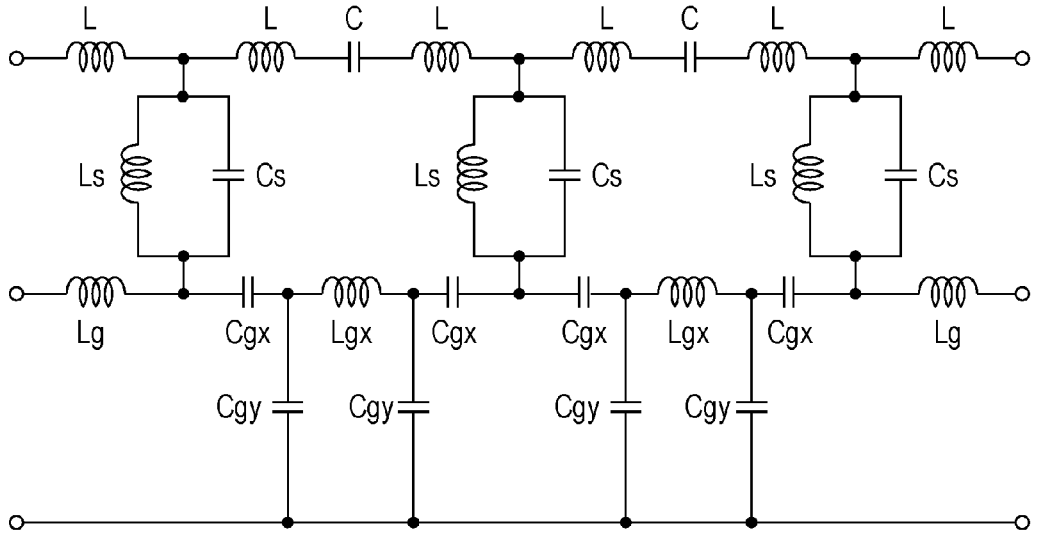
FIG. 8 is an equivalent circuit diagram of the EBG structure 7 shown in FIG. 7.

FIG. 7 is an enlarged view of the EBG structure 7 of the antenna device 100 shown in FIG. 1. FIG. 8 is an equivalent circuit diagram of the EBG structure 7 shown in FIG. 7. In FIG. 7, "L" is the inductance of each of the patch conductors 11, "Ls" is the inductance of each of the via conductors 12, "Lg" is the inductance of a portion of the grounded conductor 5 that does not face the patch conductors 11 (outside of the EBG structure 7), and "Lgx" is the inductance of each of the patch conductors 13 and the stub conductors 14. Further, "C" is the capacitance between patch conductors 11 that are adjacent to each other, and "Cs" is the capacitance between each of the patch conductors 11 and the grounded conductor 5. Furthermore, "Cgx" is the capacitance between each of the path conductors 13 and the stub conductors 14 and the grounded conductor 5, and "Cgy" is the capacitance between each of the patch conductors 13 and the stub conductors 14 and the grounded conductor 6.

The antiresonant frequency of the EBG structure 7 is determined by the capacitance and inductance of each of the components that constitute the EBG structure 7. The inductance L of a patch conductor 11 depends on the size (e.g., the length w1 of one side) of the patch conductor 11. The capacitance C between patch conductors 11 that are adjacent to each other depends on the distances dx1 and dy1 between the centers of patch conductors 11 that are adjacent to each other. The capacitance Cs between a patch conductor 11 and the grounded conductor 5 depends on the area of the patch conductor 11 and the distance dz1 between the patch conductor 11 and the grounded conductor 5. The inductance Ls of a via conductor 12 depends on the diameter φ of the via conductor 12 and the length dz1 of the via conductor 12. The diameter φ of the via conductor 12 and the length dz1 of the via conductor 12 are substantially fixed values, as they are subject to the restriction of processes. Therefore, the length w1 of one side of a patch conductor 11 and the distances dx1 and dy1 between the centers of patch conductors 11 that are adjacent to each other are the only parameters that can be changed at the time of antenna design in consideration of the restriction of processes.

The isolation effect of an EBG structure is known to be enhanced by multistaging the EBG structure. A multistaged EBG structure for example includes a plurality of substrates and is provided with a plurality of via conductors penetrating these substrates. However, no other components or wires can be provided in a portion of any of the substrates in which the via conductors are provided. This causes an increase in size of the antenna device and also causes an increase in cost.

Next, simulation results of the antenna device 100 shown in FIG. 1 are described with reference to FIGS. 9 to 14.

Figure 9:
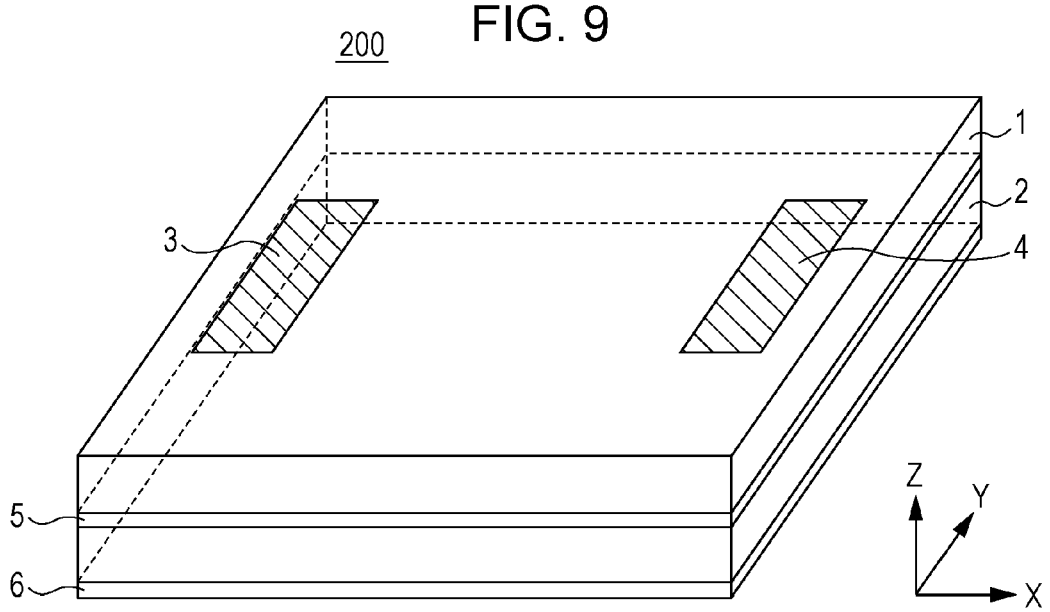
FIG. 9 shows a configuration of an antenna device 200.

FIG. 9 is a perspective view showing an antenna device 200 according to a first comparative example. The antenna device 200 shown in FIG. 9 is one obtained by removing the EBG structure 7 from the antenna device 100 shown in FIG. 1.

Figure 10:
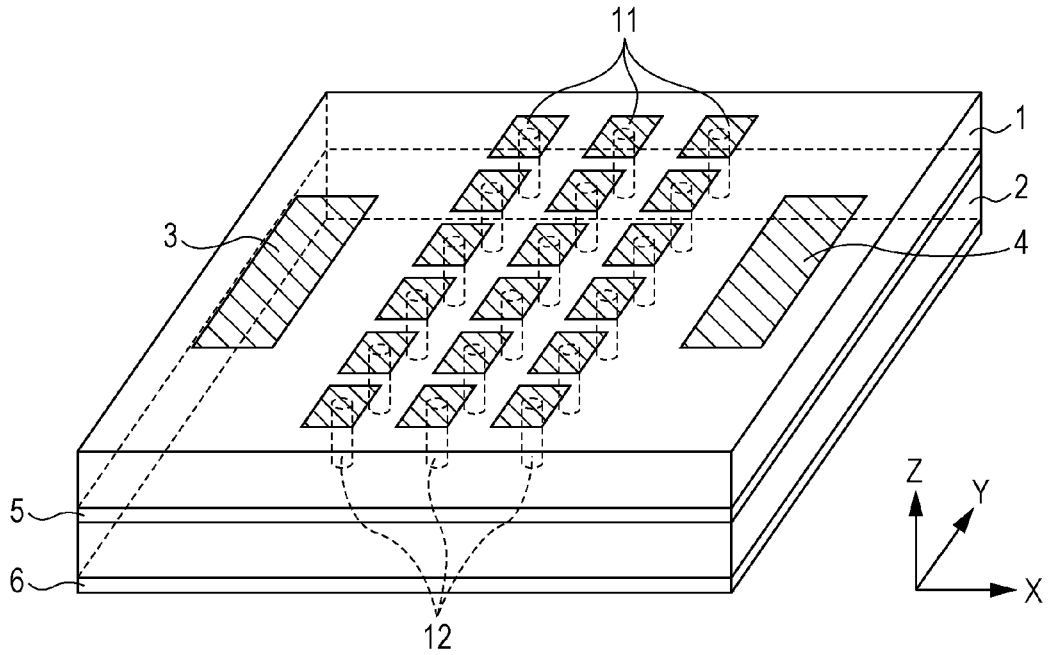
FIG. 10 shows a configuration of an antenna device 201.

FIG. 10 is a perspective view showing an antenna device 201 according to a second comparative example. The antenna device 201 shown in FIG. 10 is one obtained by removing the second EBG portion (i.e., the patch conductors 13, the stub conductors 14, and the slots 15*a* and 15*b*) from the antenna device 100 shown in FIG. 1.

Simulations were performed with parameters set as follows: the thickness dz1 of the dielectric layer 1 was 0.254 mm, and the thickness dz2 of the dielectric layer 2 was 0.3 mm; the relative dielectric constant $\varepsilon_r$ of each of the dielectric layers 1 and 2 was 3.0, and the dielectric loss tangent tan δ was 0.0058; the antenna elements 3 and 4 were 0.91 mm×0.91 mm square patch antennas; the antenna elements 3 and 4 were arranged at a distance (center-to-center distance) of 13.2 mm in the X direction; and the center frequency of the isolation band was 79 GHz.

Figure 11:
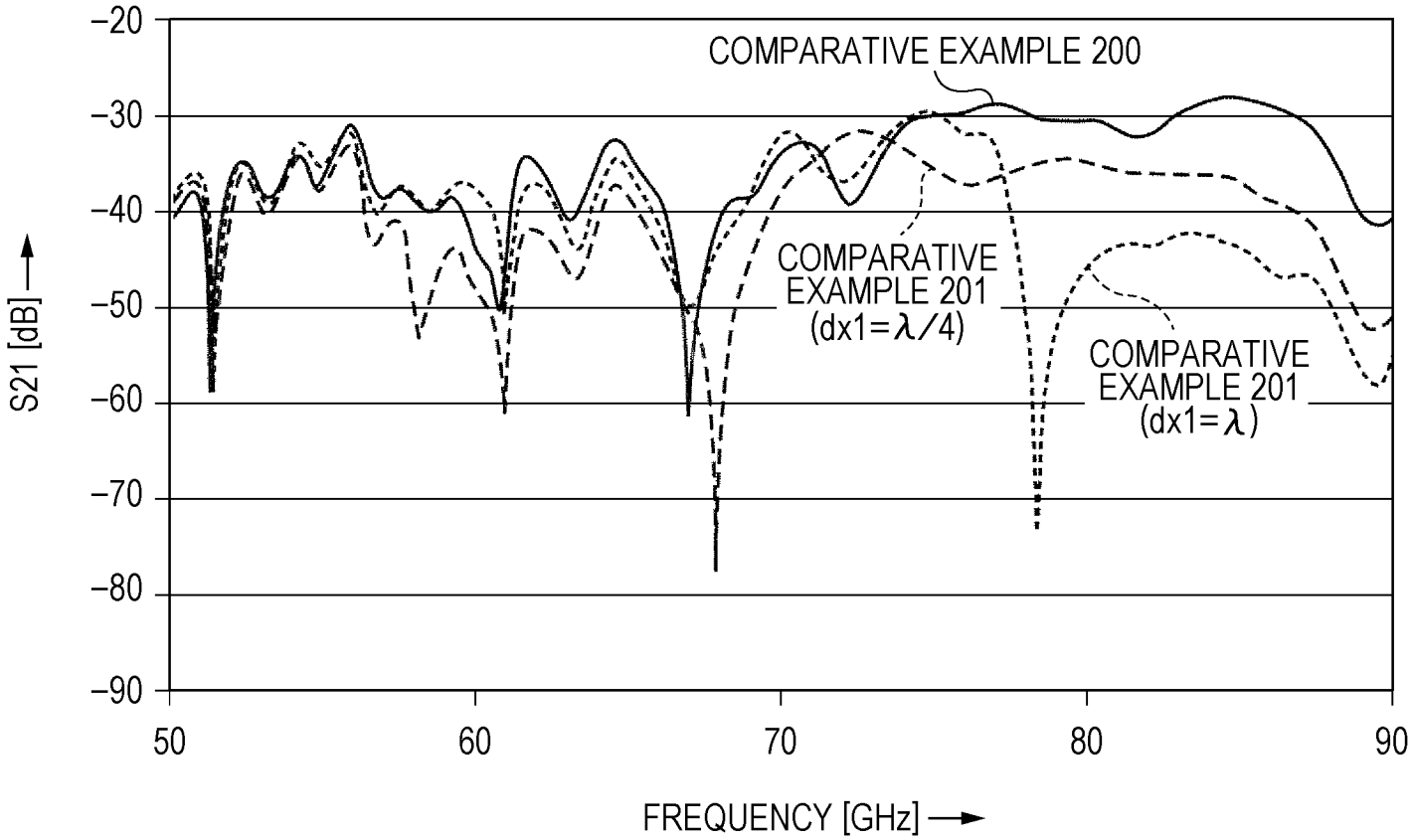
FIG. 11 shows the frequency characteristics of the antenna device 200 and the antenna device 201.

FIG. 11 is a graph of frequency characteristics (relative coupling capacitance 321 between the antenna elements) of the antenna devices 200 and 201 according to the first and second comparative examples. The antenna device 200 according to the first comparative example is configured as shown in FIG. 9 (i.e., has no EBG structure). The antenna device 201 according to the second comparative example is configured as shown in FIG. 10 (i.e., has an EBG structure including only patch conductors 11 and via conductors 12). The EBG structure of the antenna device 201 according to the second comparative example includes a matrix of three patch conductors 11 arranged in the X direction by eighty-five patch conductors 11 arranged in the Y direction between the antenna elements 3 and 4. The length w1 of one side of each of the patch conductors 11 was fixed at 0.61 mm, and the distance dy1 between the centers of two patch conductors 11 that are adjacent to each other in the Y direction was fixed at 0.71 mm. The diameter cp of each of the via conductors 12 was 0.25 mm, and the length dz1 of each of the via conductors 12 was 0.254 mm. In the antenna device 201 according to the second comparative example, the distance dx1 between the EBG segments 7-1*a*, 7-1*b*, and 7-1*c* was varied; that is, the distance dx1 was set to a wavelength λ (2.2 mm) corresponding to the center frequency of 79 GHz of the isolation band or approximately λ/4 (0.7 mm). The optimization of the distance dx1 reduces the capacitance C and the inductance Lg, thus enhancing the mutual impedance of the antenna elements 3 and 4. FIG. 11 shows that high isolation can be attained by optimizing the distance dx1 (dx1=λ).

According to FIG. 11, when the distance dx1 is set to be equal to λ in the antenna device 201 according to the second comparative example, high isolation is attained only in a narrow isolation band including the center frequency of 79 GHz of the isolation band.

Figure 12:
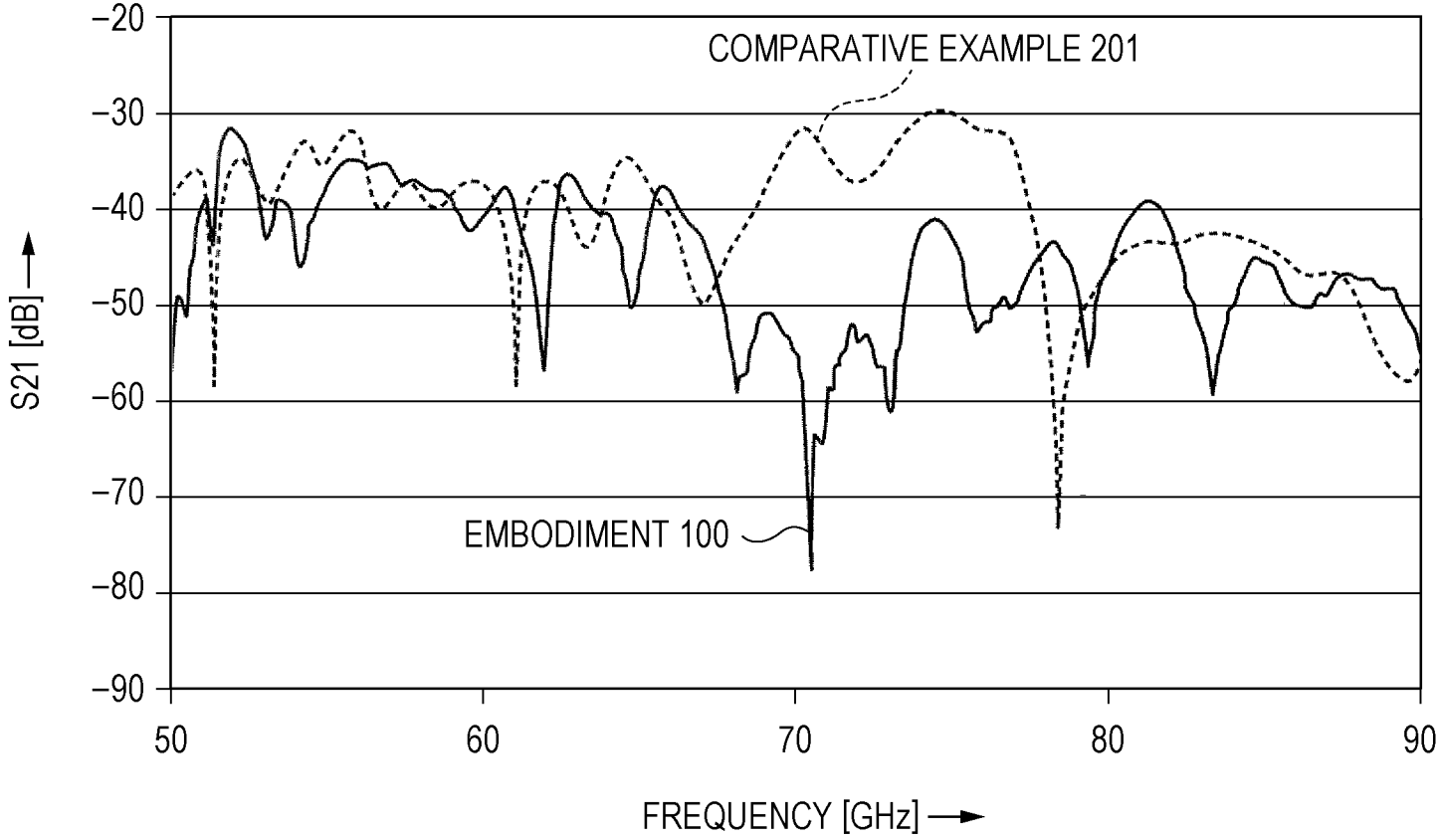
FIG. 12 shows the frequency characteristics of the antenna device 100 and the antenna device 201.

FIG. 12 is a graph of frequency characteristics (relative coupling capacitance S21 between the antenna elements) of the antenna devices 100 according to the embodiment and the antenna device 201 according to the second comparative example. The antenna device 201 according to the second comparative example is configured as shown in FIG. 10 (i.e., has an EBG structure including only patch conductors 11 and via conductors 12), and the distance dx1 was set to the wavelength λ (2.2 mm) corresponding to the center frequency of 79 GHz of the isolation band. The antenna device 100 according to the embodiment is configured as shown in FIG. 1 to include the first EBG portion (i.e., the patch conductors 11 and the via conductors 12) and the second EBG portion (i.e., the batch conductors 13 and the stub conductors 14) disposed between the antenna elements 3 and 4. The first EBG portion of the antenna device 100 according to the embodiment was configured in a manner similar to the EBG structure of the antenna device 201 according to the second comparative example. The second EBG portion of the antenna device 100 according to the embodiment included a matrix of two patch conductors 13 arranged in the X direction by forty-two patch conductors 13 arranged in the Y direction. The length w2 of one side of each of the patch conductors 13 was fixed at 1.05 mm, and the distance dy2 between the centers of patch conductors 13 that are adjacent to each other in the Y direction was fixed at 1.15 mm. The distance from each of the patch conductors 13 to the grounded conductor 5 was 0.2 mm. The length of each of the stub conductors 14 was 0.1 mm. The stub conductors 14 had open ends without being short-circuited with the grounded conductor 5. The distance from the open end of each of the stub conductors 14 to the grounded conductor 5 was 0.1 mm. In the antenna device 100 according to the embodiment, the distances dx1 and dx2 were set to the wavelength λ (2.2 mm) corresponding to the center frequency of 79 GHz of the isolation band. FIG. 12 shows that the addition of the second EBG portion (i.e., the patch conductors 13, the stub conductors 14, and the slots 15*a* and 15*b*) to the antenna device 201 according to the second comparative example achieves a wider isolation band. According to FIG. 12, isolation is improved particularly on a side of the isolation band that is lower than the center frequency of 79 GHz.

The EBG structure 7 operates as a magnetic wall to suppress the propagation of a surface wave between the antenna elements 3 and 4. The second EBG portion (i.e., the patch conductors 13, the stub conductors 14, and the slots 15*a* and 15*b*) can spread the isolation band to a lower band side or a higher band side than the antenna device 201 according to the second comparative example, which includes only the first EBG portion. Including the second EBG portion makes it possible to more surely reduce crosstalk between the antenna elements 3 and 4 than the antenna device 201 according to the second comparative example.

The antenna device 100 shown in FIG. 1, which includes both the first EBG portion and the second EBG portion and in which the distances dx1 and dx2 are set to the wavelength λ corresponding to the center frequency of 79 GHz of the isolation band, makes it possible to achieve a wider isolation band than the antenna devices 200 and 201 according to the first and second comparative examples.

Without being limited to the wavelength λ corresponding to the center frequency of 79 GHz of the isolation band, the distances dx1 and dx2 need only be lengths that are close to the wavelength λ. The effects of the distances dx1 and dx2 on the frequency characteristics are further described with reference to FIGS. 13 and 14.

Figure 13:
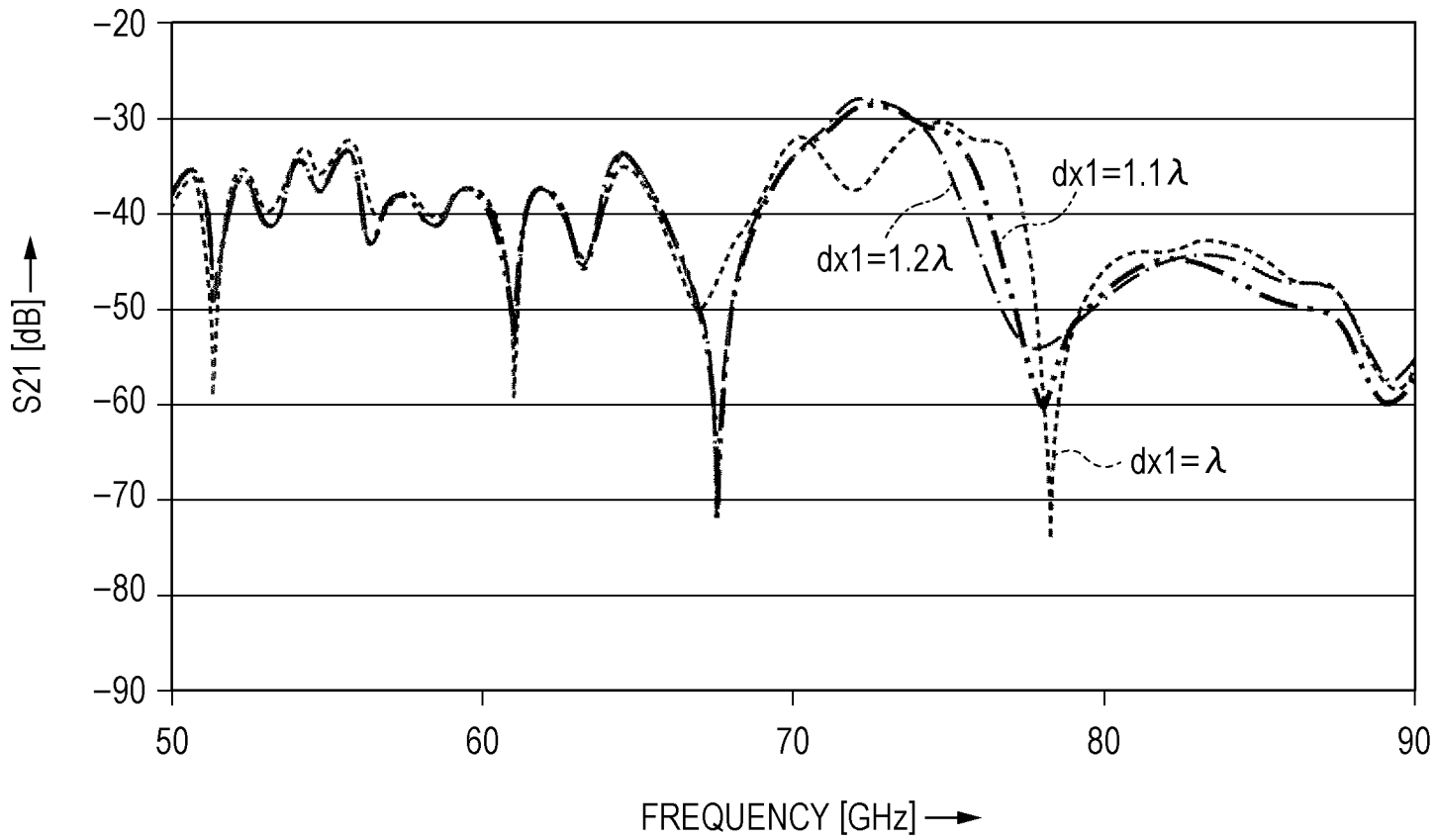
FIG. 13 shows the frequency characteristics of the antenna device 201.
Figure 14:
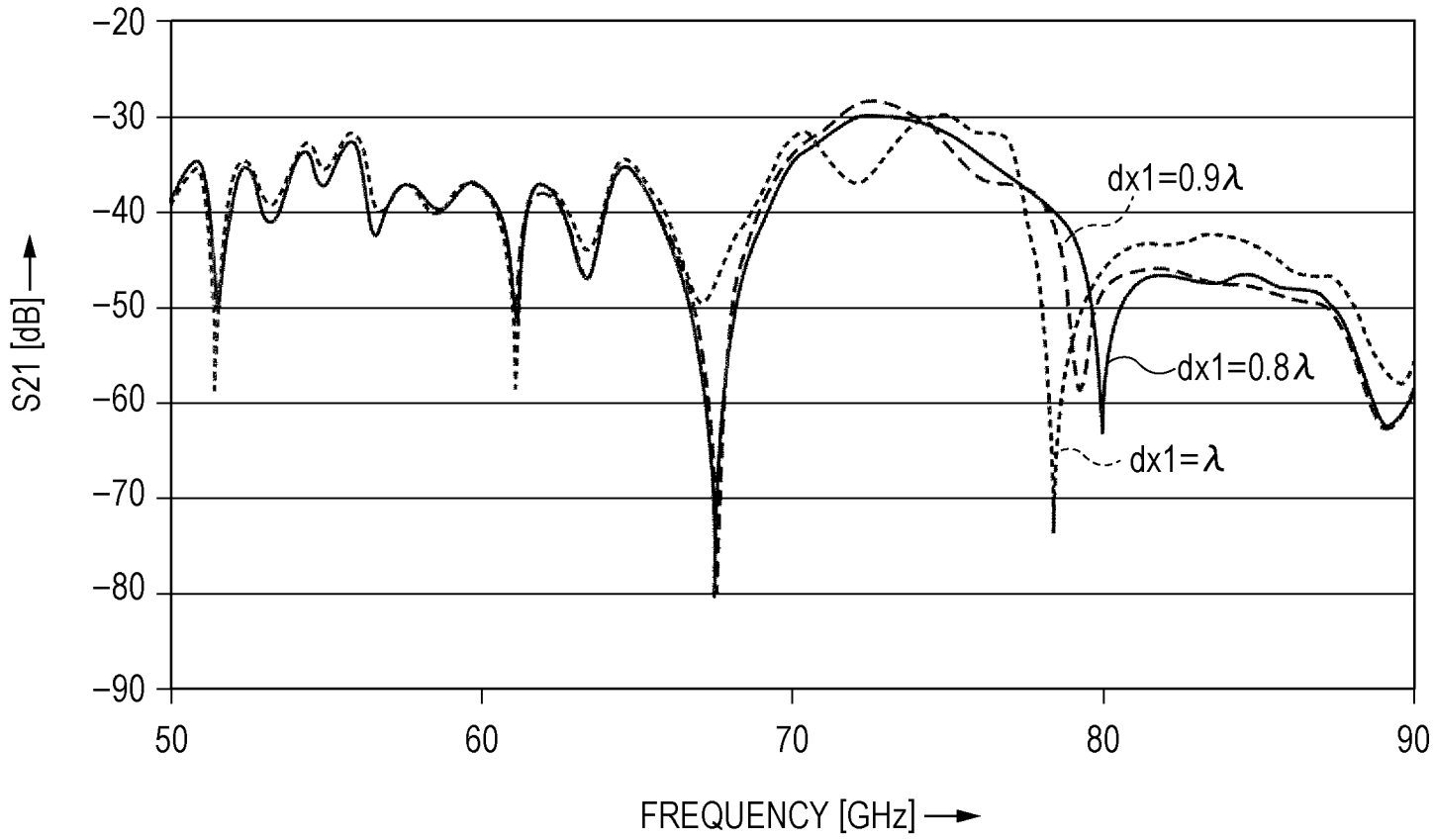
FIG. 14 shows the frequency characteristics of the antenna device 201.

FIG. 13 is a graph of frequency characteristics (relative coupling capacitance S21 between the antenna elements) of the antenna device 201 according to the second comparative example. FIG. 14 is a graph of frequency characteristics (relative coupling capacitance S21 between the antenna elements) of the antenna device 201 according to the second comparative example. For simplicity of simulation, the antenna device 201 shown in FIG. 10 was used instead of the antenna device 100 shown in FIG. 1. The distance dx1 between the EBG segments 7-1*a*, 7-1*b*, and 7-1*c* was varied; that is, the distance dx1 was set to 0.8λ, 0.9λ, 1λ, 1.1λ, or 1.2λ. FIGS. 13 and 14 show that high isolation can be ensured even when the distance dx1 is a length of 0.8λ to 1.2λ that is close to 1λ. The results shown in FIGS. 13 and 14 similarly apply to the antenna device 100 shown in FIG. 1.

Second Embodiment

Figure 15:
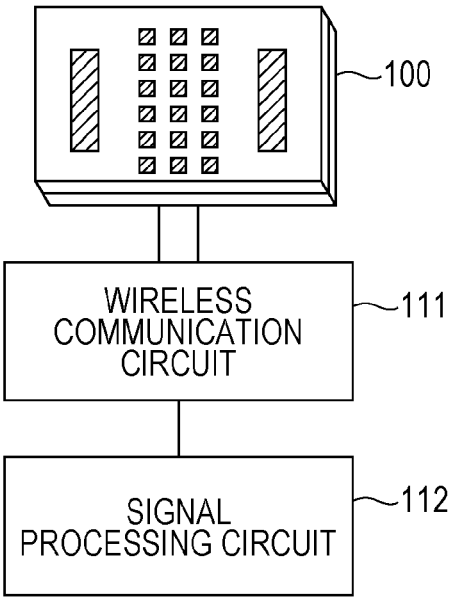
FIG. 15 shows a configuration of a wireless communication apparatus.

FIG. 15 is a block diagram showing a wireless communication apparatus according to a second embodiment. The wireless communication apparatus shown in FIG. 15 includes an antenna device 100 shown in FIG. 1, a wireless communication circuit 111, and a signal processing circuit 112. The wireless communication circuit 111 emits from the antenna device 100 a radio signal produced by modulating a baseband signal sent from the signal processing circuit, and sends to the signal processing circuit 112 a baseband signal produced by demodulating a radio signal received by the antenna device 100.

Third Embodiment

Figure 16:
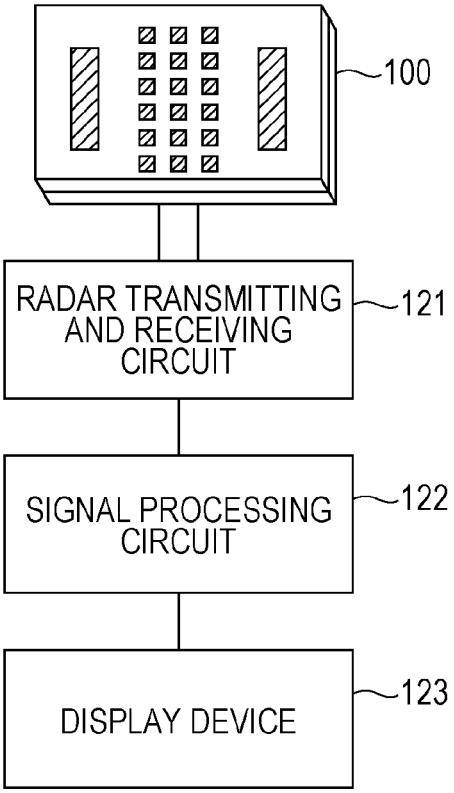
FIG. 16 shows a configuration of a radar apparatus.

FIG. 16 is a block diagram showing a radar apparatus according to a third embodiment. The radar apparatus shown in FIG. 16 includes an antenna device 100 shown in FIG. 1, a radar transmitting and receiving circuit 121, a signal processing circuit 122, and a display device 123. The radar transmitting and receiving circuit 121 radiates radar waves from the antenna device 100 under control of the signal processing circuit 122 and receives radar waves reflected by the target and entering the antenna device 100. The signal processing circuit 122 determines the distance from the antenna device 100 to the target and the speed of the target, for example, on the basis of the propagation time of and a change in frequency of radar waves, and displays the results on the display device 123.

An antenna device 100 according to each of the embodiments makes it possible to improve isolation and achieve a wide isolation band.

An antenna device, a wireless communication apparatus, and a radar apparatus according to aspects of the present disclosure are configured as follows:

An antenna device according to a first aspect of the present disclosure includes: a dielectric layer having a first surface on which a first conductor layer is provided and a second surface on which a second conductor layer is provided; a first antenna element provided in the first conductor layer; a second antenna element provided in the first conductor layer; a first grounded conductor provided in the second conductor layer; and an EBG (electromagnetic band gap) structure disposed between the first antenna element and the second antenna element, wherein the EBG structure includes a first EBG portion provided in the first conductor layer, the first EBG portion including a plurality of first patch conductors electromagnetically coupled to the first grounded conductor, and a second EBG portion provided in the second conductor layer, the second EBG portion including a plurality of second patch conductors electromagnetically coupled to the first grounded conductor.

An antenna device according to a second aspect is the antenna device according to the first aspect, wherein the plurality of first patch conductors are arranged along a plurality of first columns crossing a line segment connecting the first antenna element and the second antenna element, and the first EBG portion includes a plurality of via conductors penetrating the dielectric layer and connecting the plurality of first patch conductors to the first grounded conductor.

An antenna device according to a third aspect is the antenna device according to the first aspect, wherein the plurality of second patch conductors are arranged along a plurality of second columns crossing a line segment connecting a region in the second conductor layer that faces the first antenna element and a region in the second conductor layer that faces the second antenna element, and the second EBG portion includes a plurality of stub conductors connected to the plurality of second patch conductors.

An antenna device according to a fourth aspect is the antenna device according to the first aspect, wherein the plurality of first patch conductors are arranged along a plurality of first columns crossing a line segment connecting the first antenna element and the second antenna element, the first EBG portion includes a plurality of via conductors penetrating the dielectric layer and connecting the plurality of first patch conductors to the first grounded conductor, the plurality of second patch conductors are arranged along a plurality of second columns crossing a line segment connecting a region in the second conductor layer that faces the first antenna element and a region in the second conductor layer that faces the second antenna element, and the second EBG portion includes a plurality of stub conductors connected to the plurality of second patch conductors.

An antenna device according to a fifth aspect is the antenna device according to the fourth aspect, wherein the plurality of first columns are provided parallel to each other and separated from each other by a distance that is 0.8 to 1.2 times longer than a wavelength corresponding to a center frequency of an isolation band of the first antenna element and the second antenna element, and the plurality of second columns are provided parallel to each other and separated from each other by a distance that is 0.8 to 1.2 times longer than the wavelength corresponding to the center frequency of the isolation band.

An antenna device according to a sixth aspect is the antenna device according to any one of the first to fifth aspects, further comprising: a third conductor layer provided parallel to the second conductor layer at a predetermined distance from the second conductor layer on a side opposite to the first conductor layer; and a second grounded conductor provided in the third conductor layer.

A wireless communication apparatus of the present disclosure includes: an antenna device according to any one of the first to sixth aspects; and a wireless communication circuit.

A radar apparatus of the present disclosure includes: an antenna device according to any one of the first to sixth aspects; and a radar transmitting and receiving circuit.

Antenna devices according to aspects of the present disclosure are applicable as antenna devices, wireless communication apparatuses, and radar apparatuses that operate in millimeter-wave bands.

What is claimed is:

1. An antenna device comprising:

a dielectric layer having a first surface on which a first conductor layer is provided and a second surface on which a second conductor layer is provided;

a first antenna element provided in the first conductor layer;

a second antenna element provided in the first conductor layer;

a first grounded conductor provided in the second conductor layer; and an electromagnetic band gap (EBG) structure provided between the first antenna element and the second antenna element, wherein the EBG structure includes:

a first EBG portion provided in the first conductor layer, the first EBG portion including a plurality of first patch conductors electromagnetically coupled to the first grounded conductor, and a second EBG portion provided in the second conductor layer, the second EBG portion including a plurality of second patch conductors electromagnetically coupled to the first grounded conductor, wherein the plurality of second patch conductors are arranged along a plurality of second columns crossing a line segment connecting a region in the second conductor layer that faces the first antenna element and a region in the second conductor layer that faces the second antenna element, and the second EBG portion includes a plurality of stub conductors connecting the plurality of second patch conductors and the first grounded conductor.

2. The antenna device according to claim 1, wherein the plurality of first patch conductors are arranged along a plurality of first columns crossing a line segment connecting the first antenna element and the second antenna element, and the first EBG portion includes a plurality of via conductors penetrating the dielectric layer and connecting the plurality of first patch conductors to the first grounded conductor.

3. The antenna device according to claim 2, wherein the plurality of first columns are provided parallel to each other and separated from each other by a distance that is 0.8 to 1.2 times longer than a wavelength corresponding to a center frequency of an isolation band of the first antenna element and the second antenna element, and the plurality of second columns are provided parallel to each other and separated from each other by a distance that is 0.8 to 1.2 times longer than the wavelength corresponding to the center frequency of the isolation band.

4. The antenna device according to claim 1, further comprising:

a third conductor layer provided parallel to the second conductor layer at a predetermined distance from the second conductor layer on a side opposite to the first conductor layer; and a second grounded conductor provided in the third conductor layer.

5. A wireless communication apparatus comprising:

an antenna device; and a wireless communication circuit, wherein the antenna device includes:

a dielectric layer having a first surface on which a first conductor layer is provided and a second surface on which a second conductor layer is provided, a first antenna element provided in the first conductor layer, a second antenna element provided in the first conductor layer, a first grounded conductor provided in the second conductor layer, and an EBG (electromagnetic band gap) structure provided between the first antenna element and the second antenna element, and the EBG structure includes:

a first EBG portion provided in the first conductor layer, the first EBG portion including a plurality of first patch conductors electromagnetically coupled to the first grounded conductor, and a second EBG portion provided in the second conductor layer, the second EBG portion including a plurality of second patch conductors electromagnetically coupled to the first grounded conductor, wherein the plurality of second patch conductors are arranged along a plurality of second columns crossing a line segment connecting a region in the second conductor layer that faces the first antenna element and a region in the second conductor layer that faces the second antenna element, and the second EBG portion includes a plurality of stub conductors connecting the plurality of second patch conductors and the first grounded conductor.

6. A radar apparatus comprising:

an antenna device; and a radar transmitting and receiving circuit, wherein the antenna device includes:

a dielectric layer having a first surface on which a first conductor layer is provided and a second surface on which a second conductor layer is provided, a first antenna element provided in the first conductor layer, a second antenna element provided in the first conductor layer, a first grounded conductor provided in the second conductor layer, and an EBG (electromagnetic band gap) structure provided between the first antenna element and the second antenna element, and the EBG structure includes:

a first EBG portion provided in the first conductor layer, the first EBG portion including a plurality of first patch conductors electromagnetically coupled to the first grounded conductor, and a second EBG portion provided in the second conductor layer, the second EBG portion including a plurality of second patch conductors electromagnetically coupled to the first grounded conductor, wherein the plurality of second patch conductors are arranged along a plurality of second columns crossing a line segment connecting a region in the second conductor layer that faces the first antenna element and a region in the second conductor layer that faces the second antenna element, and the second EBG portion includes a plurality of stub conductors connecting the plurality of second patch conductors and the first grounded conductor.

* * * * *